United States Patent [19]

Jones

[11] 4,038,854

[45] Aug. 2, 1977

[54] PLUG CHANGER FOR PLUG MILL

[75] Inventor: Russell E. Jones, New Castle, Pa.

[73] Assignee: Aetna-Standard Engineering Company, Ellwood City, Pa.

[21] Appl. No.: 682,920

[22] Filed: May 4, 1976

[51] Int. Cl.[2] ..... B21B 25/06

[52] U.S. Cl. ..... 72/209

[58] Field of Search ..... 72/209, 208, 97

[56] References Cited

U.S. PATENT DOCUMENTS

| | | | |
|---|---|---|---|
| 3,927,547 | 12/1975 | Schonfeld et al. | 72/209 X |
| 3,955,392 | 5/1976 | Prevot | 72/209 |

*Primary Examiner*—Milton S. Mehr

*Attorney, Agent, or Firm*—Mandeville and Schweitzer

[57] ABSTRACT

An automatic plug changer is disclosed, particularly for a plug mill, although some features may have applicability in conjunction with related mills, such as piercing and reeling mills. A rotatable drum is mounted below the pass line of the mill and has pockets for containing a plurality of mandrel plugs. A combined plug support and discharge trough is movably positioned between the plug-containing drum and the mill rolls, and is aligned with a plug-receiving position in the drum. After a tubular shell has been driven through the mill, over a mandrel plug, the plug simply drops out of the mill, slides down the discharge trough and is received in the drum. The drum then indexes to a new position, bringing a new plug into alignment with the trough. A pusher mechanism then moves the plug out the drum and onto the discharge trough. The trough is then pivoted upwardly and becomes part of the inlet trough for the tube shell, positioned to be passed through the mill, serving to support the plug until it is picked up by the incoming tube shell. The new mechanism improves the overall efficiency of the plug mill by substantially reducing the time required for the plug change cycle to occur.

13 Claims, 7 Drawing Figures

PLUG CHANGER FOR PLUG MILL

BACKGROUND AND SUMMARY OF THE INVENTION

In the production of seamless tubing, the tubular workpieces, referred to as shells, typically are passed through a plug mill, in order to reduce the wall thickness of the shell, as well as its outside diameter. Typically, the pierced shell, in a red hot condition, is advanced into the plug mill rolls, at which point it is picked up and driven by the mill rolls over a sizing mandrel plug. As the tubular shell passes. through and is discharged from the mill rolls, the mandrel plug, which is now extremely hot, is removed from the mandrel, the mill rolls is opened slightly, and the shell is driven backwards through the mill in a non-working pass. As non as the shell is upstream of the mill rolls, a new mandrel plug is brought into working position, and the shell, having been rotated 90°, is again advanced into the mill for a second working pass. Typically, the plug mill cycle consists of two passes, after which the shell is removed for further processing. In almost all cases, it is the practice to remove and replace the mandrel plug after each working pass through the mill, so that the just-used plug can be cooled before it is used in a subsequent operation.

Originally, the changing the mandrel plugs was performed manually, and this is still the case in many of the existing plug mills of earlier design. As will be appreciated, however, because the tub shells are being processed in a red hot condition, and because the mandrel plugs are extremely hot after use and they are often very heavy, the task of a mandrel plug changer is both difficult and dangerous. As a result, it is been proposed heretofore to employ mechanical mechanisms for replacement and removal of mandrel plugs. In general, prior mechanisms for this purpose have been limited in one or more ways, such as mechanical impracticability in the very severe environment of a plug mill, excessively long cycle time, or the like.

In accordance with the present invention, a new and improved plug changer is provided, particularly for a plug mill, which is mechanically simplified and rugged, yet which permits a plug change cycle to be completed in an extremely short time. The system of the invention incorporates a rotatable drum for the containment of a plurality of mandrel plugs, a feature which in itself is known. However, in conjunction with a rotatable drum, novel and improved arrangements are provided for supplying mandrel plugs to and from the drum and to and from working positions in the bite of the mill rolls.

In accordance with one of the more specific aspects of the invention, a pivoting, trough-like plug support is provided in conjunction with the plug holding drum, which is movable between inclined and horizontal working positions. In its inclined position, the trough-like support is arranged to receive a justused mandrel plug as it falls by gravity from its working position in the mill, and to guide the used plug into a vacant pocket in the holding drum. In addition, in its inclined position, the trough-like support is arranged to receive a new plug from the holding drum. In its horizontal position, the trough-like support holds the plug in alignment with the tubular shell, advancing toward the mill rolls, such that the plug is picked up by the advancing shell and driven by the shell into working position. As it is moved from its inclined to its horizontal position, the trough-like support serves as an elevator, carrying the new mandrel plug upwardly into a ready position on the pass line of the mill.

In accordance with another and more specific feature of the invention, improved arrangements are provided for mounting and securing the trough-like support, described above, which, on the one hand, enables the discharge end of the support to extend as far as practicable into the bite of the mill, while at the same time easily accommodating removal and replacement of the mill rolls, as is required frequently when readying the mill for a new size of tube. To this end, provisions are made for displacement of the trough-like support independently of its normal pivoting motion, enabling the support to be quickly and easily displaced out of the way of the mill rolls without requiring any part of the plug feeding mechanism to be dismantled and removed.

In accordance with a further aspect of the invention, an improved arrangement is provided for pushing a new plug out of its pocket in the holding drum and onto the inclined supporting trough. Since the pushed-out mandrel plug will tend to slide by gravity down the inclined support trough, it is held in position by the pusher until the support trough is pivoted upward to elevate the plug into its ready position. For this purpose, the pusher mechanism incorporates a pivoted abutment plate, which engages the lower end of the mandrel plug and serves to guide and displace the plug during upward pivoting movement of the support trough. When the pusher mechanism is retracted, the abutment member assumes a new position, at a different angle, and serves, in effect, as a bottom wall for the active pocket of the holding drum.

For a better understanding of the above and other features and advantages of the invention, reference should be made to the following detailed description of a preferred embodiment, and to the accompanying drawings.

PRIOR ART OF INTEREST

The following U.S. patents relate to various forms of plug changer mechanisms, useful in plug mills or similar mills: Franceschina et al. Pat. No. 3,924,435, Schonfeld et al. Pat. No. 3,762,201, Kelly Pat. No. 3,277,687, Kelso Pat. No. 2,699,697, Gettig Pat. No. 2,635,492, Burns Pat. No. 1,931,571, Wikstrom Pat. No. 1,537,206; and British Patent Specification No. 1,180,004.

DESCRIPTION OF A PREFERRED EMBODIMENT OF THE INVENTION

Figure 1:
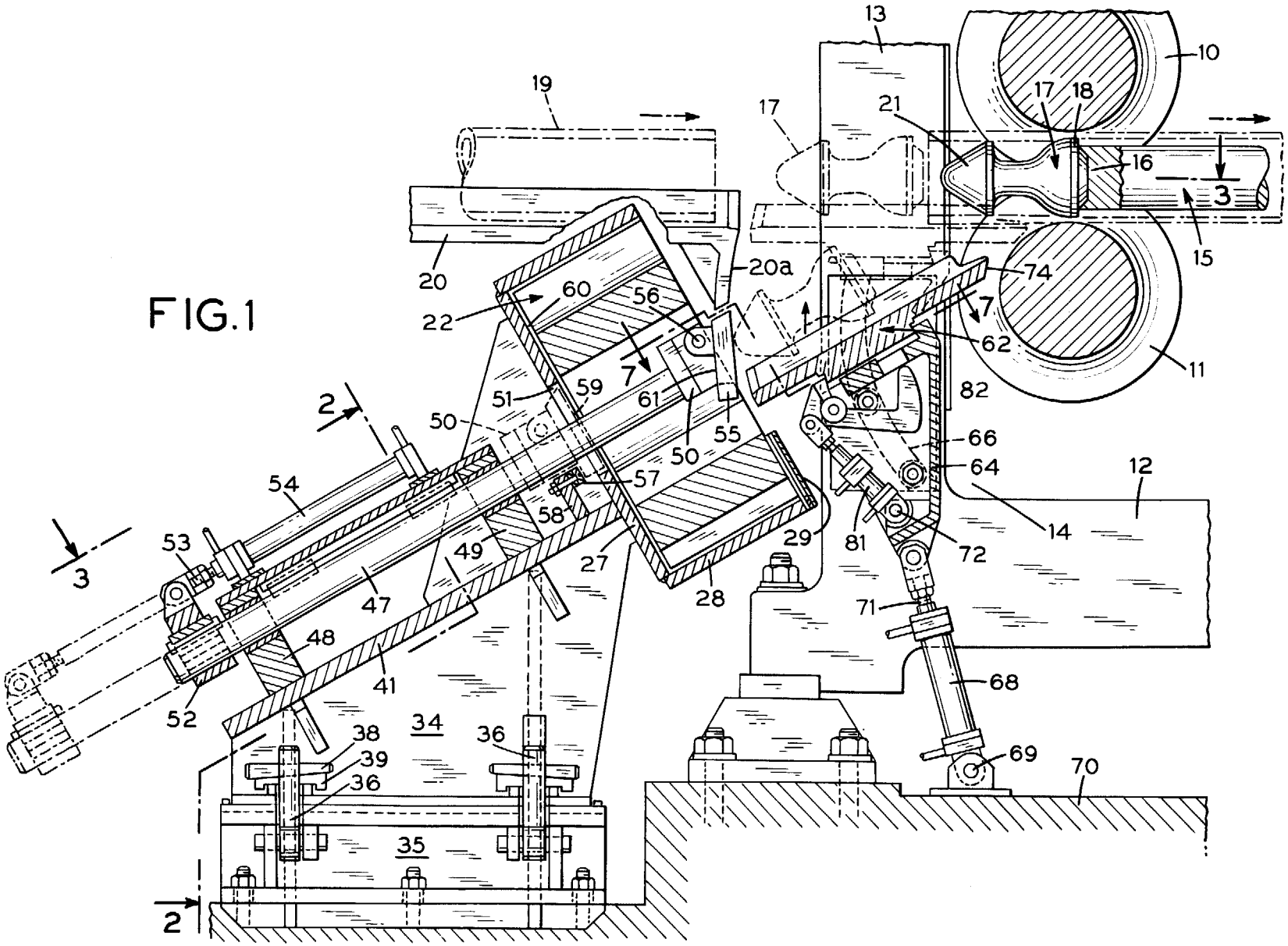
FIG. 1 is a longitudinal cross sectional view of a plug mill changer constructed in accordance with the principles of the invention, shown in association with a conventional plug mill, as is taken generally on line 1—1 of FIG. 2.

Referring now to the drawings, and initially to FIG. 1 thereof, the reference numerals 10, 11 represent working rolls of a plug mill, which are suitably supported in a mill housing frame 12 having upright support 13. The structure of the mill itself is known and not part of the present invention, it being understood that the mill rolls 10, 11 are suitably driven and are readily interchangeable in the mill housing 12 by lateral withdrawal through the opening 14. A mandrel 15, of a length suitable to the maximum tubing length to be accommodated, is anchored at its downstream end and is normally positioned so that its upstream end 16 is located approximately at the working plane of the mill. A mandrel plug 17 is arranged to be supported on the upstream end of the mandrel 15, with its working diameter 18 at the nip of the mill rolls.

In the normal operation of the plug mill, a tubular shell 19, received from a prior tube-forming operation and in a red hot condition, is supported on an inlet trough 20 and is advanced toward the mill rolls 10, 11 by means of a shell pusher mechanism. Advantageously, tthe shell pusher may be such as that described and claimed in the copending application of Robert A. Remner et al. Ser. No. 682,917, filed May 7, 1976. As the tube shell approaches the bite of the mill rolls, it first engages a guide section 21 of the mandrel plug and then engages the plug at its working diameter 18. Continued pushing action of the shell drives the mandrel plug until it is seated against the end of the mandrel 15 and the shell is gripped by the working rolls. Thereafter, the shell is pulled through the mill by the action of the working rolls alone, and the shell pusher returns to a ready position.

Normally, a shell is given two passes through the plug mill, and after each pass the mandrel plug 17 is removed and replaced by a new plug. After the plug is removed, but before it is replaced, the mill rolls 10, 11 are opened slightly and socalled stripper rolls (not shown) are brought into position to grip the tube shell on the discharge side of the mill rolls and return it at high speed to the entry side of the mill. After the tube is returned to the entry side, a new plug is brought into position and the shell is advanced for a second pass.

In the illustrated form of the invention, an inventory of mandrel plugs is provided by a holding drum 22, which is mounted in cantilever fashion on a heavy shaft 23 journaled in bearings 24, 25. The holding drum 22 is provided with a plurality of plug-receiving pockets 26, which are open at both longitudinal ends and also at the circumference of the drum. In the illustrated arrangement, the holding drum is provided with six plug pockets, but the number is not significant to the invention.

Figure 2:
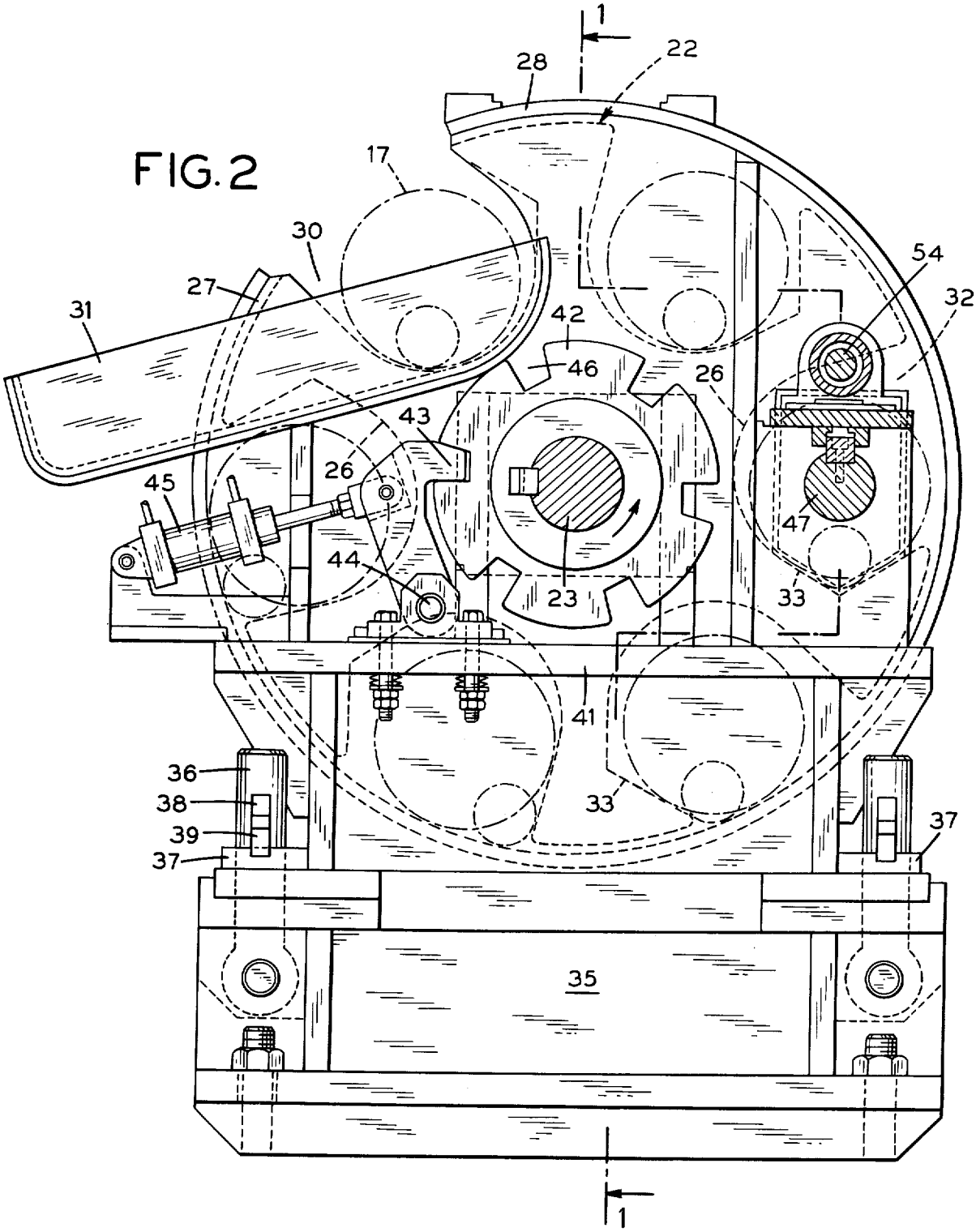
FIG. 2 is a cross section taken generally on line 2—2 of FIG. 1.

As shown in FIGS. 1 and 2, the holding drum is partly enclosed by a back wall 27, circumferential wall 28 and front wall 29. The back and circumferential walls serve to support part of the weight of the stored mandrel plugs and are of relatively heavy construction. The front wall 29 is primarily a retaining wall for cooling liquid, which may be held in the lower part of the drum housing.

In one of the upper quadrants, the circumferential wall 28 and back wall 27 are cut away to provide an inspection port 30 from which the condition of the mandrel plug may be readily observed. In addition, there may be provided, in conjunction with the inspection port 30, an inclined tray 31 into which the mandrel plug may be rolled for inspection purposes or for the purpose of loading or removing plugs into or from the inspection port.

One of the pocket positions 32 (FIG. 2) of the holding drum may be considered as its working position, from which new mandrel plugs are obtained and into which used mandrel plugs are discharged. To advantage, the configuration of the holding drum pockets 26 is such as to provide a V-shaped supporting wall structure 33, which is directly underneath the mandrel plug 17 in the working pocket location 32. This serves to properly align and guide the mandrel plug 17 in relation to other parts of the system, as will appear.

As shown in FIG. 1, the entire holding drum mechanism is mounted on an inclined support, generally designated by the numeral 34. This support is secured to a base structure 35 by means of a plurality of swing pins 36, which are engageable with flanges 37 of the drum support by means of wedges 38 and keys 39. The arrangement is such as to accommodate quick, bodily removal of the entire holding drum assembly, as may be desired from time to time.

Controlled rotation of the holding drum 22, to bring successive plug pockets 26 into the working position 32, may be accomplished by a hydraulic motor 40, which is mounted on a base plate 41 and is connected to the main drum supporting shaft 23. Also keyed to the shaft 23 is a latch shell 42, which cooperates with a latch pawl 43 pivoted at 44 on the base plate 41 and actuated by means of a latching cylinder 45. In the illustrated arrangement, it is intended that the plug holding drum 22 be rotated in a clockwise direction, as viewed in FIG. 2, to bring successive pockets 26 into the working position 32. When it is desired to rotate the drum, the latch cylinder 45 is actuated to withdraw the latch pawl 43 from one of the latch wheel pockets 46, and the hydraulic motor 40 is energized to effect a controlled rotation of the drum. The desired amount of rotation may encompass one or more pocket positions, depending on the particular sequence of operations employed in the mill. In any case, as the drum reaches its final position, the latch cylinder 45 is again actuated to drive latch pawl 45 into a new pocket 46 of the latch wheel, thus locking the drum in its new position.

Figure 3:
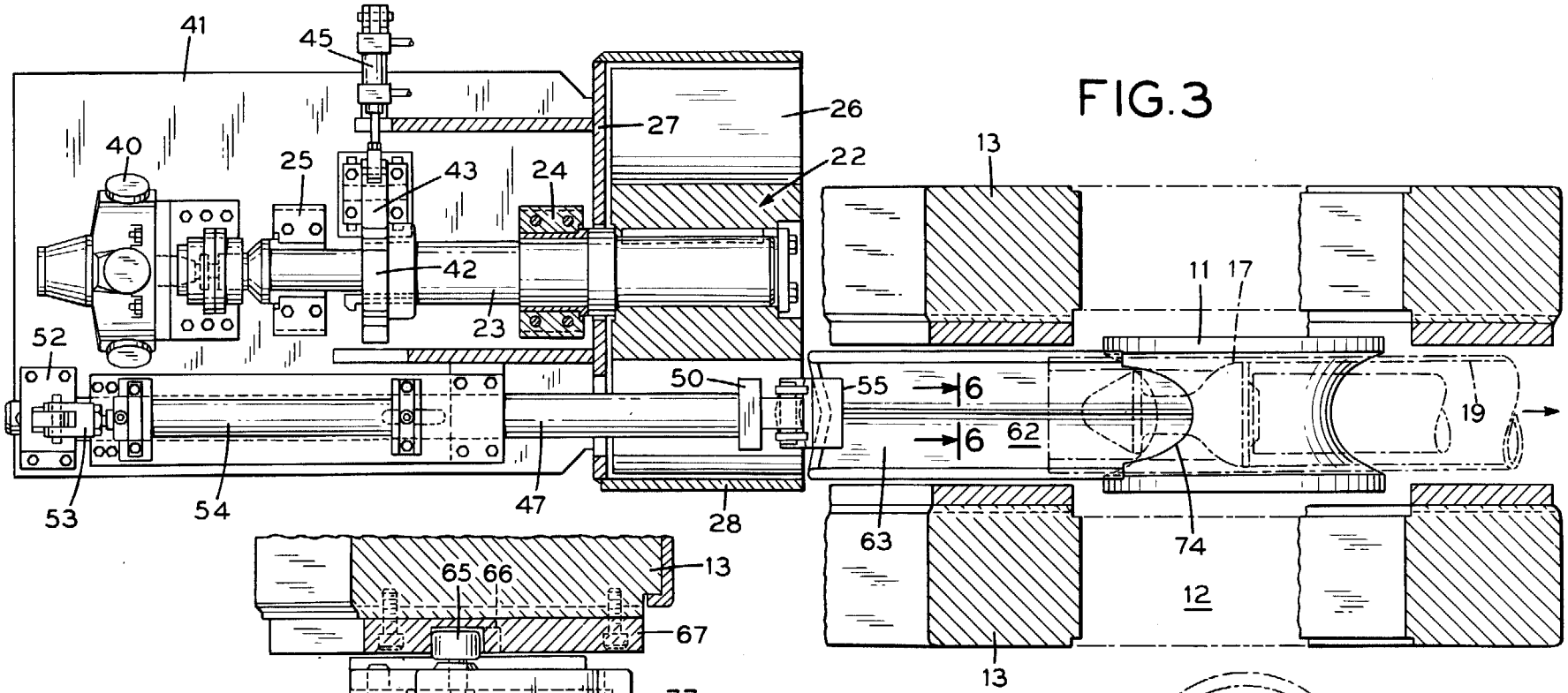
FIG. 3 is a fragmentary, cross sectional view as taken generally on line 3—3 of FIG. 1.
Figure 6:
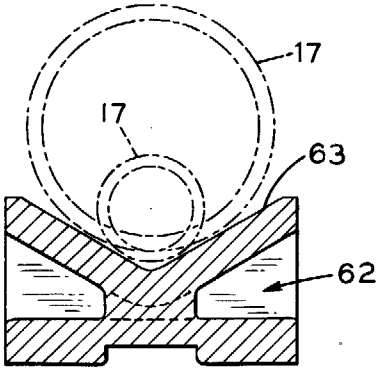
FIG. 6 is a fragmentary, cross sectional view as taken generally on line 6—6 of FIG. 3.
Figure 7:
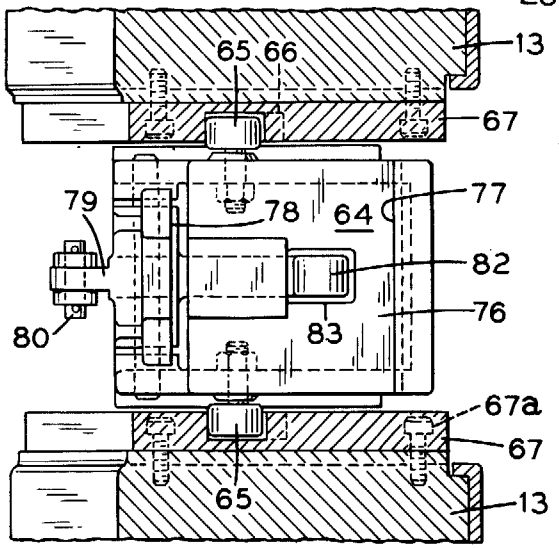
FIG. 7 is an enlarged, fragmentary cross sectional view as taken generally on line 7—7 of FIG. 1.

As illustrated particularly in FIGS. 1 and 3, a pusher ram 47 is slideably mounted in guide bearings 48, 49 on the base plate 41 in axial alignment with the working pocket position 32 of the holding drum. The ram 47 has a pusher head 50 at its upper or forward end, which is receivable in a correspondingly shaped opening 51 in the back plate 27 of the drum housing, enabling the pusher head 50 and ram to be advanced into and through the holding drum pocket which is at the working position 32.

At its lower or rearward end, the ram 47 is secured by a clamp 52 to the rod end 53 of an actuating cylinder 54 secured rigidly to the base structure 34. When the cylinder 54 is extended, the ram 47 is moved to a retracted position, as shown in phantom lines in FIG. 1, and when the cylinder 54 is retracted, the ram 47 is advanced to an extended position as shown in full lines in FIG. 1.

To advantage, the pusher head 50 incorporates an abutment plate 55 which is pivoted at 56 to the base of the pusher head and is swingable through a limited arc about the axis of the pin.

As reflected in FIG. 1, the pusher head 50 has an angularly disposed front face 61, which serves to limit the pivoting action of the abutment plate 55 when the ram 47 moves forward, in a pushing direction. Thus, when the ram is advanced, to push a mandrel plug 17 out of its pocket and onto a supporting and elevating transfer trough 62 (to be described in further detail) the abutment plate 55 pivots back to a near-vertical position. In this respect, it will be noted in FIG. 1 that the abutment plate 55 contacts the mandrel plug 17 along an axis below the pivoting axis 56 of the abutment plate. Thus, in the extended position of the ram 47, the abutment plate 55 serves to confine and guide the mandrel plug 17 during upward movement of the plug to the working level of the mill. In its pivoted position, the abutment plate is substantially aligned with a downward extension 20*a* of the main loading trough 20.

With reference more particularly to FIGS. 4—7, the transfer trough 62 comprises a casting or weldment formed to provide a V-shaped upper platform surface 63 for supporting, along a central plane, mandrel plugs 17 (which may be of various different sizes) being received from or discharged into the holding drum 22. In this respect, the cross sectional configuration of the platform surface 63 may correspond substantially to the V-shaped surface 33 of the holding drum pockets, and the surfaces 63, 33 are substantially aligned when the transfer trough 62 is in its lowered or loading position.

To advantage, the transfer trough 62 is mounted on a transfer carriage 64, which is supported and guided by rollers 65 in arcuate tracks 66 formed in guide plates 67 mounted by bolts 67*a* at each side of the entry-side mill frame members 13. The arcuate tracks 66 are designed to have a center of rotation which is approximately coincident with the axis 67*b* of the lower mill roll 11 (allowing for the fact that the diameter of the mill roll may be varied), such that the carriage 64 and the transfer trough 62 may be moved (between upper and lower positions without significantly changing the relationship thereof to the mill rolls. A fluid cylinder 68 is pivotally mounted at 69 on the mill foundation 70, and has its rod end 71 pivotally connected at 72 to the lower end of the transfer carriage 64. When the cylinder 68 is retracted, the transfer trough 62 is aligned with the working pocket of the holding drum 22 and, when the cylinder 68 is extended, the transfer trough is raised into alignment with the main guide trough 20 leading to the mill rolls, as is reflected in phantom lines in FIGS. 1 and 5.

To advantage, the length of the platform 63 of the transfer trough 62 is such that its rearward end 73 is closely adjacent the front face of the holding drum when the trough is in its loading position. The forward extremity 74 of the platform is arranged to extend well into the grooved portion of the mill roll, in order to provide maximum support for the tubular shell 19 as it advances to the working roll pass with the mandrel plug. To this end, the forward end 74 of the transfer trough platform is shaped to conform generally to the contours of the grooved roll, the contours of the transfer trough being sufficiently narrow, however, as to permit the use of a common transfer trough 62 with a plurality of different groove sizes of the mill rolls.

Figure 5:
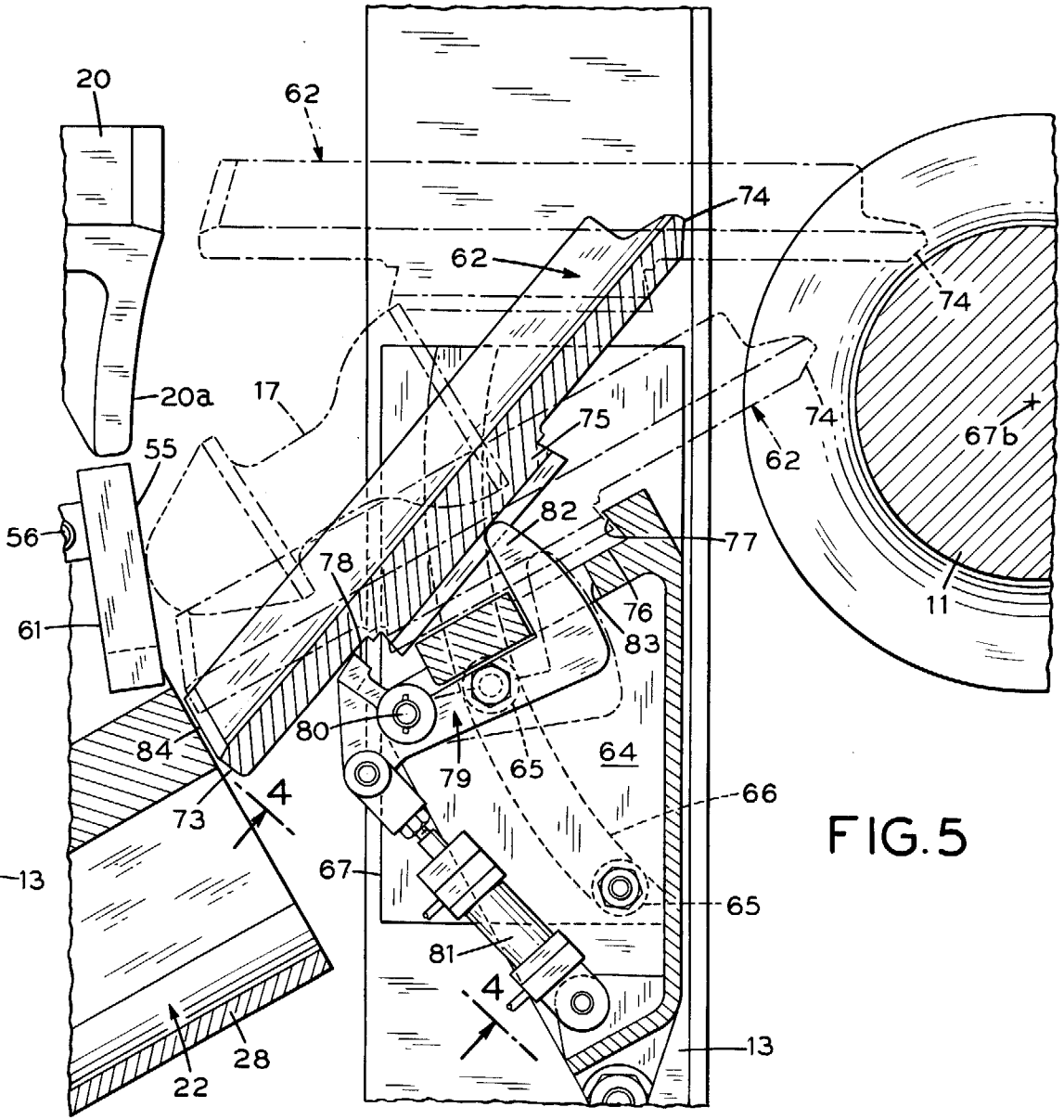
FIG. 5 is an enlarged, fragmentary cross section view as taken generally on line 5—5 of FIG. 4.
Figure 4:
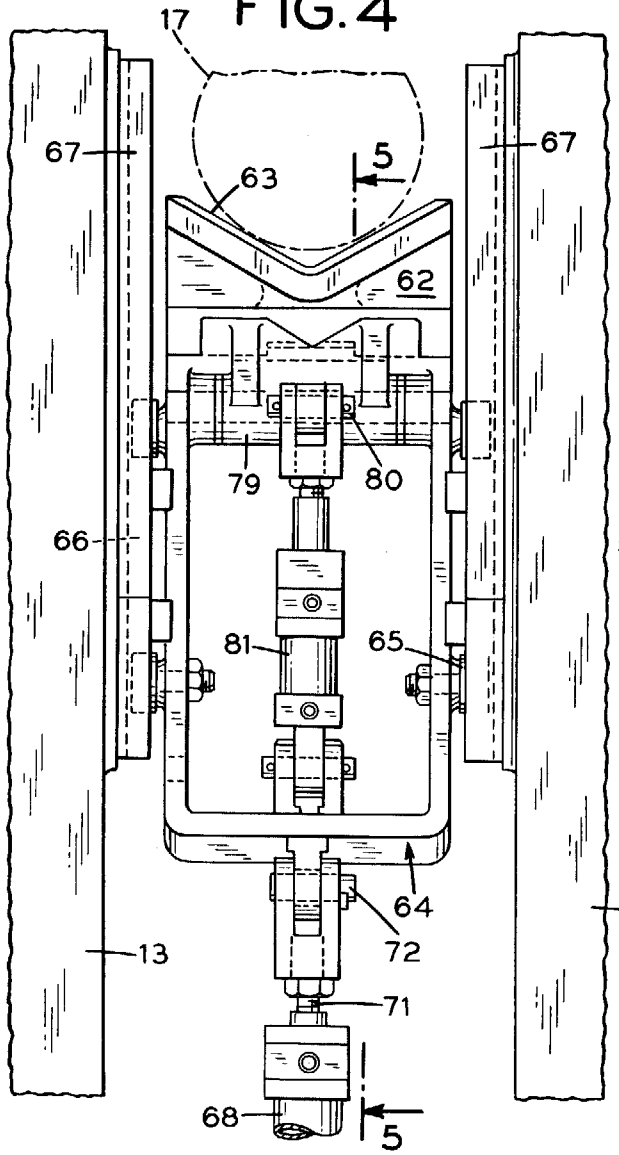
FIG. 4 is a fragmentary, enlarged view, as taken generally on line 4—4 of FIG. 5, showing details of the mounting of the mandrel plug support trough.

As reflected particularly in FIGS. 1 and 5, the transfer trough 62 is provided with a dovetailed base section 75, which is received in a similarly shaped dovetailed pocket 76 in the transfer carriage. The forward side of the pocket is formed by a fixed, angular wall 77, while the back side of the pocket is formed by an angular surface 78 formed on a lever 79 pivoted at 80 on the transfer carriage and operated by means of a fluid cylinder 81. Desirably, the lever 79 includes a lifting finger 82 which is projectable through an opening 83 in the upper wall of the transfer carriage for engagement with the bottom of the transfer trough 62. When the cylinder 81 is extended, the lever 79 is pivoted clockwise, withdrawing the lifting finger 82 and urging the movable dovetail surface 78 into clamping position, tightly securing the transfer trough 62 in the dovetailed slot 76. When the cylinder 81 is retracted, clamping pressure on the transfer trough 62 is released, and simultaneously the lifting finger 82 projects through the opening 83, engaging the bottom of the trough 62 and causing it to pivot upwardly about the back edge of its base such that, as shown in FIG. 5, the trough is withdrawn entirely from the window area formed by the mill supports 13. This enables the mill rolls to be withdrawn laterally from the mill, as is necessary from time to time for refurbishing of the rolls and/or changing of the rolls for a new size of tubing. At the same time, when the cylinder 81 is returned to its normal or extended position, the transfer trough 62 is again secured in its normal working position, with its forward extremity 74 projecting well within the peripheral confines of the mill rolls. If necessary or desirable, the rearward end extremity 84 of the transfer trough may be bevelled slightly, to permit further retracting movement of the trough against the end face of the holding drum, when the trough is tilted upward by the action of the fluid cylinder 81.

SUMMARY OF OPERATION

A sequence of operations is commenced by causing the transfer trough 62 to be moved to its retracted or loading position, and activating the ram cylinder 54 to push a mandrel plug 17 out of the working pocket of the drum 22 and onto the transfer trough 62. The ram 47 is retained momentarily in its extended position, while the transfer carriage 64 and transfer trough 62 are elevated by the fluid cylinder 68. As the trough 62 rises, it moves through an arcuate path determined by the grooves 66, about an axis which is generally in the area of the axis of the lower roll 11. The now-angularly disposed front face of the abutment plate 55 guides the mandrel plug 17 during the initial phase of its upward movement, until it is transferred onto the fixed guide surface 20*a* extending from the main loading trough 20. When the transfer trough 62 reaches its upper to transfer position, it is aligned with and forms an effective continuation of the main loading trough 20. Once the mandrel plug 17 has been elevated to its transfer position, a tubular shell 19 can be advanced by the shell pusher (not shown) toward the mill rolls 10, 11, picking up the mandrel plug 17 as it advances, and causing the leading end of the shell, together with the mandrel plug, to be driven into the bight of the mill rolls. The mandrel plug is thereby seated against the mandrel 15, and the mill roll pick up the leading ends of the tube shell and drive it through the mill to effect the desired working pass. As soon as the transfer carriage 64 has moved to its elevated position, the abutment plate 55 no longer serves a guide function, and the ram 47 is retracted to its back position.

During the rolling phase, while the shell is being driven over the plug just loaded in the mill bit, the latch pawl is released and the drum is rotated 120° (counterclockwise as viewed in FIG. 2). This increment of rotation serves to carry the previously used plug from the inspection port 30 down into the lower portion of the drum housing, where it is cooled by liquid in the housing. At the same time, an empty drum pocket is moved into alignment with the working position.

As soon as the rolling phase has been completed, and the shell passes over the plug, the plug falls by gravity into the empty drum pocket at the working position. Immediately thereafter, the drum is rotated through a 120° increment to bring the just-used plug up to the inspection port, while simultaneously bringing the cooled plug upward from the cooling bath into the working position. The used plug remains in the inspection port while the new plug is loaded into the mill by operation of the ram 47, but as soon as the ram retracts, the drum is rotated through a further 120° increment to carry the used plug from the inspection port down into the cooling water, while bringing an empty pocket into working position ready to receive the next plug.

Typically, a shell is given two passes through the plug mill. Between the first and second passes, it is returned to the upstream side of the mill rolls and is rotated 90°. After the second pass, the shell is again returned to the entry-side of the mill and discharged from the main loading through 20. A new shell is then brought into position for a further cycle.

As used mandrel plugs are returned to the holding drum, and the holding drum is indexed progressively through its cycle, the mandrel plugs enter a bath of cooling liquid in the lower portion of the drum housing, and are caused and permitted to be cooled down to a desired working temperature. In some cases auxiliary sprays may be directed at the plug to enhance cooling. After each use, the mandrel plug is carried up by the indexing drum to the inspection port 30, where it may be visually inspected by the mill operator before being used again. If any defect is noted, the plug may be quickly removed and replaced with a new plug at the inspection port.

Where it is desired to operate the holding drum 22 with a greater complement of circulating mandrel plugs, the drum can be indexed through a 60° angle (or none at all) between the offloading of a mandrel plug and its return after the end of the rolling phase.

The arrangement of the invention contributes significantly to the high speed operation of a plug mill, by reducing to a minimum the cycle time involved in removing and replacing mandrel plugs. By way of example only, a plug mill installation, utilizing the plug changer apparatus of the invention, is capable of completing a two-pass rolling cycle of a tubular shell in twenty-eight seconds, including the loading and removal of mandrel plugs, and the rolling in two passes of a tubular shell having a finished O.D. of about 165 mm and a finished length on the order of 16.5 m. In the representative cycle referred to, the approximate time involved between the end of one mill pass and the commencement of another is less than eight seconds. In this time, the old mandrel plug is released and slides down the transfers trough 62 into an empty drum pocket, the holding drum is indexed to a new position, the ram pushes a new plug onto the transfer trough, and the trough is elevated up to the transfer position, in readiness to receive the advance of the shell. As will the readily appreciated, by effecting plug change at such a high rate of speed, the overall productivity of the plug mill may be greatly increased.

In the system of the invention, important advantages are derived from the use of a plug magazine, most advantageously in the form of rotary drum, which is disposed at an inclined angle below the working pass of the mill, with one working pocket aligned with the mill bite. A transfer trough is movable in a pivoting fashion between a loading position and a transfer position. In the loading position, the trough is aligned with the working pocket and with the mill bite, enabling it to serve as a slide or chute for directing the fall by gravity of a used mandrel plug into the working pocket of the plug magazine. This same transfer trough serves to receive a new plug, displaced out of the magazine by a ram, and to transfer tthe plug, through an arcuate movement of the trough, up to a transfer position, in which it supports the plug in alignment with the working axis of the mill. As soon as a new plug has been picked up by the shell and inserted in the mill, this trough is pivoted back to an inclined position, ready to receive that same mandrel plug, a few second later, as the shell is discharged from the exit-side of the mill.

The design of the plug pusher or ram is unique in providing for a pivoting abutment plate at the forward end of the ram. In the retracted position, the abutment plate is pivoted into alignment with the back wall of the plug magazine and serves as a continuation thereof. When the ram is extended, the abutment plate is pivoted to a different position, in which it serves to confine and guide the mandrel plug during upward movements of the transfer trough to elevate a new plug into the transfer position.

An additional feature of advantage resides in the construction of the transfer trough 62 and its supporting carriage 64 is such manner as to permit the trough, in its normal working position, to project well within the peripheral outlines of the working rolls, yet which permits the trough to be quickly tipped up and out of the way to accommodate lateral withdrawal of the mill rolls. By avoiding the necessity of complete physical removal of the transfer trough the permit roll change, the downtime involved in completing a roll change may be reduced.

It should be understood, of course, that the specific form of the invention herein illustrated and described is intended to be representative only, as certain changes may be made therein without departing from the clear teachings of the disclosure. Accordingly, reference should be made to the following appended claims in determining the full scope of the invention.

I claim:

1. A plug changer for a plug mill or the like, wherein the mill has a pair of mill rolls, a guide trough upstream of the mill rolls for guiding a tubular workpiece into the roll bite, a mandrel supported on the discharge side of the mill rolls and adapted to supported a mandrel plug at the roll bits, which comprises a. a plug holding drum mounted adjacent and below said guide trough, for rotation about an inclined central axis, and having pockets for the reception of a plurality of mandrel plugs, b. means for controllably rotating said drum about its inclined central axis for bringing plug receiving pockets successively into a predetermined inclined working position below and at an intersecting angle with said guide trough.

c. a transfer trough mounted between said plug holding drum and said mill rolls, d. means movably supporting said transfer trough for angular movement between a loading position, substantially at said intersecting angle with said guide trough, and a transfer position, e. said transfer trough, in said loading position, being generally aligned with the drum pocket in said working position, to accommodate movement of a mandrel plug into or out of such drum pocket, f. said transfer trough in said transfer position being substantially aligned with and effectively forming an extension of said main guide trough, whereby to enable a mandrel plug, supported on said transfer trough in the transfer position, to be picked up by an incoming tubular workpiece and carried out mandrel-supported position in said roll bite, g. a plug pusher ram aligned with and, when retracted, effectively forming the lower end of the plug receiving pocket located at said working position, and h. means to advance said ram from its retracted position to displace a mandrel plug out of said last mentioned pocket and onto said transfer trough, i. said ram forming a guide surface for upwardly guiding a mandrel plug while said transfer trough is being moved from said loading position to said transfer position, j. said transfer trough, when in said loading position, forming a discharge chute for guiding a used mandrel by gravity back into a drum pocket in said working position.

2. A plug changer for a plug mill or the like, wherein the mill has a pair of mill rolls, a guide trough upstream of the mill rolls for guiding a tubular workpiece into the roll bite, a mandrel supported on the discharge side of the mill rolls and adapted to support a mandrel plug at the roll bite, which comprises a. a plug holding drum mounted adjacent said guide trough and having pockets for the reception of a plurality of mandrel plugs, b. means for controllably rotating said drum about its central axis for bringing plug receiving pockets successively into a predetermined working position, c. a transfer trough mounted between said holding drum and said mill rolls, d. means movably supporting said transfer trough for movement between loading and transfer positions, e. said transfer trough, in said loading position, being generally aligned with the drum pocket in said working position, to accommodate movement of a mandrel plug into or out of such drum pocket, f. said transfer trough in said transfer position being substantially aligned with and effectively forming an extension of said main guide trough, whereby to enable a mandrel plug, supported on said transfer trough in the transfer position, to be picked up by an incoming tubular workpiece and carried into mandrel-supported position in said roll bite, g. said plug holding drum being mounted for rotation about an inclined axis such that the drum pocket at said working position is on an inclined working axis approximately aligned with the bite of the mill rolls, h. said transfer trough being supported for movement between a loading position, substantially aligned with said inclined working axis, and a horizontal transfer axis, substantially aligned with said guide trough, and i. said transfer trough being mounted for arcuate movement about an axis generally near the axis of rotation of the lower mill roll.

3. A plug changer according to claim 2, further characterized by a. said lower mill roll being grooved to correspond with the tubular stock to be processed, b. said transfer trough including a forward portion extending into the grooved portion of the lower mill roll.

4. A plug changer according to claim 3, further characterized by a. a transfer carriage mounting said transfer trough for said arcuate movement, b. said transfer carriage being positioned entirely outside the peripheral outlines of said lower mill roll, and c. means for upwardly tilting the extending forward portion of said transfer trough on said transfer carriage sufficiently that said forward portion lies entirely outside the peripheral outlines of said lower mill roll, to accommodate lateral removal of said mill roll.

5. A plug changer for plug mills and the like, of the type having a rotary plug holding drum and means for transferring plugs from the drum to the bite of the mill, which comprises a. means mounting said drum for rotation, b. said drum having a plurality of plug receiving pockets, c. means for rotating said drum to bring said pockets successively into a predetermined working position, d. said working position being aligned along a predetermined inclined axis substantially intersecting with the pass line in the region of the roll bite, e. a transfer trough positionable along said inclined axis to receive a used plug from said roll bite and direct said plug by gravity into a drum pocket at said working position, f. mens to displace a new plug from a pocket of said drum, aligned with said axis, and onto said transfer trough, g. means for displacing said transfer trough, together with a new plug, into alignment with said pass line, h. a plug pusher ram aligned with said inclined axis and having a pusher head engageable with a mandrel plug, said ram being movable between a retracted position, in which said pusher head is at the back of the drum pocket at said working position, and an extended position, in which said pusher head is in front of said drum pocket, j. said pusher head, in the extended position of said ram, serving to guide and support a mandrel plug during upward displacement of said transfer trough, k. said pusher head including a pivoted abutment plate, l. means effective when said ram is in a retracted position to pivot said abutment plate into a first position substantially coincident with and forming part of the back wall of said holding drum, and m. means effective when said ram is in an extended position to pivot said abutment plate into a second position effective to confine and guide a mandrel plug during at least the initial upward displacement of said transfer trough.

6. A plug changer for plug mills and the like, of the type having a rotary plug holding drum and means for transferring plugs from the drum to the bite of the mill, which comprises a. means mounting said drum for rotation, said drum having a plurality of plug receiving pockets, c. means for rotating said drum to bring said pockets successively into a predetermined working position, d. said working position being aligned along a predetermined inclined axis substantially intersecting with the pass line in the region of the roll bite, e. a transfer trough positionable along said inclined axis to receive a used plug from said roll bite and direct said plug by gravity into a drum pocket at said working position, f. means to displace a new plug from a pocket of said drum, aligned with said axis, and onto said transfer trough, g. means for displacing said transfer trough, together with a new plug, into alignment with said pass line, h. said drum having a plurality of plug receiving pockets therein extending from the front face to the back face of the drum, i. means for retaining mandrel plugs in said pockets comprising a drum-enclosing housing having a back wall closely adjacent the back of said drum and against which mandrel plugs are urged by gravity, j. said back wall having an opening at said working position, k. a plug advancing ram mounted at the back of said housing and having a plug pusher head at its forward end normally positioned at the opening in said back wall, and l. said pusher head including an abutment plate normally forming a substantial continuation of the surface of said housing back wall.

7. A plug changer according to claim 6, further characterized by a. said abutment plate being mounted for pivoting movement on said pusher head whereby, upon extension of said ram, said abutment plate moves from an initially inclined positin to a more vertical position, b. said abutment plate, in its more vertical position, serving to guide and support a mandrel plug during upward displacement of said transfer trough.

8. A plug changer for plug mills and the like, of the type having a rotary plug holding drum and means for transferring plugs from the drum to the bite of the mill, which comprises a. means mounting said drum for rotation about an axis below the pass line of the mill, b. said drum having a plurality of plug receiving pockets, c. means for rotating said drum to bring said pockets successively into a predetermined working position, d. said working position being aligned along a predetermined inclined axis substantially intersecting with the pass line of the mill in the region of the roll bite, e. a transfer trough positionable along said inclined axis to receive a used plug from said roll bite and direct said plug by gravity into a drum pocket at said working position, f. a plug pusher ram aligned with said inclined axis and having a pusher head engageable with a mandrel plug.

g. said ram being movable between a retracted position, in which said pusher head is at the back of the drum pocket at said working position, and an extended position, in which said pusher head is in front of said drum pocket, h. means for pivotally displacing said transfer trough, together with a new plug, into alignment with said pass line, and i. means for supporting the lower end of the mandrel plug during upward displacement of said transfer trough.

9. A plug changer for a plug mill or the like, wherein the mill has a pair of mill rolls, a guide trough upstream of the mill rolls for guiding a tubular workpiece into the roll bite, a mandrel supported on the discharge side of the mill rolls and adapted to support a mandrel plug at the roll bite, which comprises a. a plug holding drum mounted below said guide trough and having pockets for the reception of a plurality of mandrel plugs, b. means for controllably rotating said drum about its central axis for bringing plug receiving pockets successively into a predetermined working position, c. a transfer trough mounted between said holding drum and said mill rolls, d. a transfer carriage supporting said transfer trough for arcuate movement between loading and transfer positions, e. said transfer trough having a transversely disposed mounting base of dovetail-like configuration.

f. said transfer carriage having a receiving pocket of dovetail-like configuration for engaging and securing said base, g. the upstream side of said pocke being formed in part by a pivoting lever, and h. means for actuating said pivoting lever for controllably clamping and releasing said trough.

10. A plug changer according to claim 9, further characterized by a. said transfer trough being upwardly pivotable when released to enable the downstream end of the trough to be moved clear of the peripheral outline of the mill rolls.

11. A plug changer according to claim 10, further characterized by a. said pivoting lever including a lifting finger operative, when pivoted to unclamp said transfer trough, to simultaneously upwardly pivot said trough.

12. A plug changer according to claim 9, further characterized by a. means for guiding said transfer carriage in arcuate movement comprising means forming opposed arcuate guide grooves at the sides of the mill, and b. guide wheels carried by said carriage and engageable in said grooves.

13. A plug changer according to claim 12, further characterized by a. said guide grooves having a center of curvature generally adjacent the axes of the lower mill roll.

* * * * *